United States Patent [19]

Bührer

[11] 4,114,678

[45] Sep. 19, 1978

[54] MOLD FORMING APPARATUS WITH MOLD FLASK BRACER MEANS

[76] Inventor: Erwin Bührer, Vögelingässchen 40, 8200 Schaffhausen, Switzerland

[21] Appl. No.: 764,953

[22] Filed: Feb. 2, 1977

[30] Foreign Application Priority Data

Sep. 14, 1976 [CH] Switzerland ..... 11636/76

[51] Int. Cl.[2] ..... B22C 15/02

[52] U.S. Cl. ..... 164/207; 164/212; 164/383

[58] Field of Search ..... 164/37, 38, 39, 40, 164/169, 207, 208, 209, 210, 211, 212, 379, 380, 381, 382, 383, 394, 395, 396, 195, 196, 197

[56] References Cited

U.S. PATENT DOCUMENTS

| | | | |
|---|---|---|---|
| 1,784,995 | 12/1930 | Morris et al. | 164/212 |
| 3,695,339 | 10/1972 | Toccone | 164/207 X |

FOREIGN PATENT DOCUMENTS

| | | | |
|---|---|---|---|
| 660,705 | 5/1938 | Fed. Rep. of Germany | 164/383 |
| 720,480 | 4/1942 | Fed. Rep. of Germany | 164/383 |
| 289,246 | 10/1931 | Italy | 164/207 |
| 440,568 | 12/1967 | Switzerland | 164/207 |

*Primary Examiner*—Robert L. Spicer

*Attorney, Agent, or Firm*—Toren, McGeady and Stanger

[57] ABSTRACT

In mold forming apparatus wherein molding sand contained in a mold flask is subjected to compressive forces, bracer devices acting in opposed relationship against the mold flasks are provided in order to supprt the sides of the flasks against the forces generated therein during compression of the molding sand. The bracer devices act against structural parts of the molding apparatus or machine which are located to be fixed in position relative to the mold flasks during the compression of the sand and the bracer devices are arranged to consist of bracer bolts which are adapted to be brought into engagement against the sides of the mold flasks by wedge devices sliding relative to the fixed structural parts and actuated preferably by fluid pressure means.

11 Claims, 10 Drawing Figures

MOLD FORMING APPARATUS WITH MOLD FLASK BRACER MEANS

BACKGROUND OF THE INVENTION

The present invention relates generally to apparatus for the production of casting molds and more particularly to apparatus wherein material for forming a casting mold is compressed within molding flasks containing the material.

In mold forming equipment of the type to which the present invention relates, substantial increases in the sizes of the molding flasks which are utilized as a result of mechanization or automation of plants within which such equipment is operated has effected a considerable increase in the degree of deformation or distortion which occurs in the walls of the molding flask during the compression therein of the mold forming material or molding sand. Plastic or elastic deformation of the molding flasks will be subjected to added increase during compression by the introduction of high pressure molding. The elastic deformation of the molding flasks during compression is further increased during compression as a result of the application of new filling methods of the molding sands in the molding flasks, the profiled sand filling being stripped off before the compression on the top side in adaptation to the pattern volume.

The elastic deformation which occurs in the walls of the molding flask tends to attain a maximum degree of deformation during compression of the molding sand particularly when the patterns which are utilized in forming the casting molds have a relatively large volume. The deformation of the molding flask produces the additional disadvantage in that it enhances breakoff of mold balls and mold edges during separation of the casting mold parts from the pattern device.

Furthermore, offset of the castings tends to be increased and the accuracy of the dimensions or size of the castings is also impaired as a result of the deformation which may occur in the molding flasks.

Heretofore, the most effective manner for preventing elastic deformation of molding flasks has involved the utilization of stiffening means consisting of traverses or stiffening devices which are installed to extend across the mold flask. The traverses, however, produce the significant disadvantage that they reduce the molding flask inner space which is available for utilization and that the uniformity of compression of the casting mold parts is also impaired. Since such traverses also affect the disassembly of the casting moles in that such disassembly is rendered more difficult, they are no longer utilized in molding and casting plants.

Other known approaches have involved attempts to achieve stiffening of the molding flasks by increasing the profiles of the molding flasks taken in the bending direction and by designing them as hollow bodies. However, experience has shown that the desired stiffening effects for molding flasks cannot be achieved by measures such as these.

Accordingly, there exists a need for providing support for molding flasks utilized in equipment for forming casting molds.

The present invention is directed toward achievement of appropriate support and bracing for molding flasks utilized in mold forming equipment during the compression of casting mold parts.

SUMMARY OF THE INVENTION

Briefly, the present invention may be described as an improvement in mold forming apparatus for the production of casting molds in molding flasks operating to compress the molding material contained in such flasks by the provision of bracer means including bracer elements which act in opposed relationship to each other against the molding flasks to brace the flasks, and structural means located to be fixed in position relative to the mold flasks during the compression of the mold forming material contained therein, the bracer means operating to brace the mold flasks against said fixed structural means.

In accordance with the invention the object is achieved by providing at least one bracer means or supporting device for each mold unit in order to support the molding flask of the mold unit against a machine part or structural element which does not change position relative to the molding flask during the performance of the compression step whereby the mold material contained in the flask is compressed.

In a preferred embodiment of the invention the bracer means are formed to consist of bracer bolts which can be adjusted relative to the molding flask by wedge means sliding upon a machine part.

Other preferred embodiments of the invention are provided wherein a spring operating to bias the bracer bolt to return to its initial position is provided, where the wedge means is actuated by fluid pressure means such as pneumatic or hydraulic cylinders preferably in a vertical direction, with the height of the wedge being less than the distance between piston rod surfaces actuating the wedge. The bracer means are arranged to bear on parts of the mold table or on columns which are rigidly connected both with the mold table and with the press or with a cross piece.

With the bracing effect which is achieved according to the invention against the molding flask of the casting mold unit during the compression of the molding materials there results a condition whereby the molding flasks which are used may be made of ordinary sections having no stiffening traverses or other like elements, with the elastic deformation of the flasks being maintained so small during compression that there does not result either breakoff of mold balls or mold edges or increases in the offset of the castings or reduction in the accuracy of the size or dimensions thereof.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
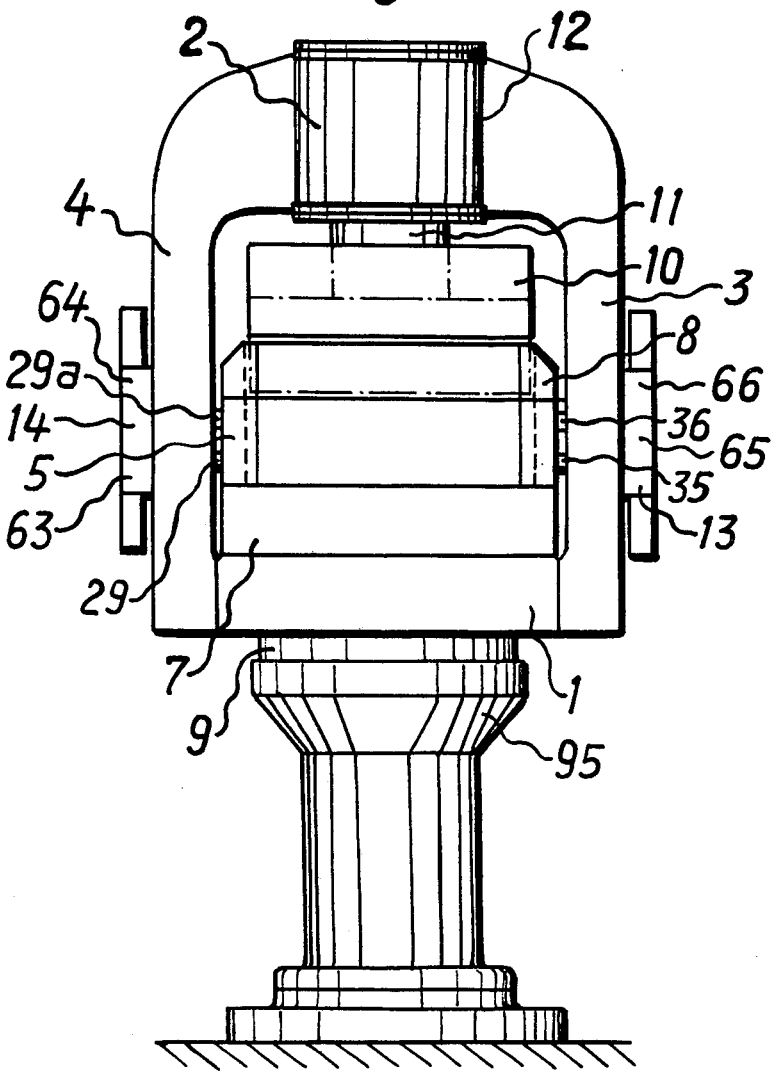
FIG. 1 is an elevational view of apparatus embodying the present invention, the view of FIG. 1 being taken in the direction of the arrow I shown in FIG. 2.
Figure 2:
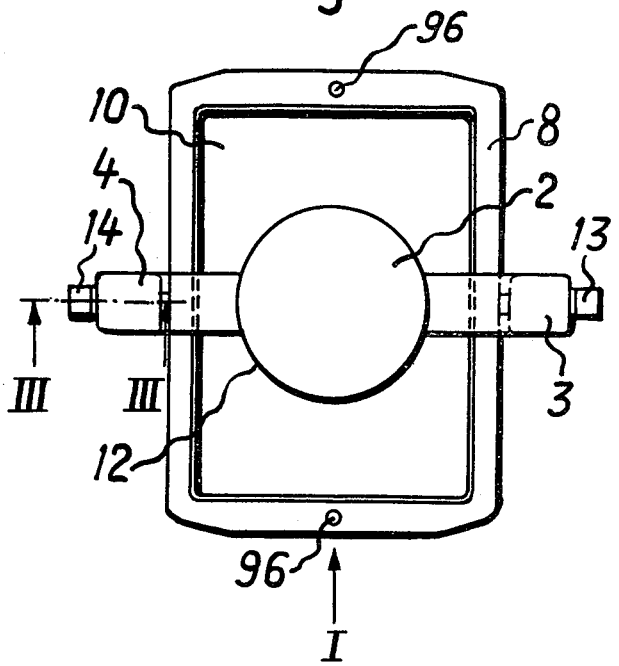
FIG. 2 is a plan view of the apparatus shown in FIG. 1.

Referring now to the drawings wherein similar reference numerals refer to like parts throughout the various figures thereof, there is depicted in FIGS. 1 and 2 mold forming apparatus wherein the present invention is embodied. The apparatus shown in FIGS. 1 and 2 include a mold table 1, a press 2 and a pair of columns 3 and 4 which are rigidly connected with each other and which essentially comprise a fixed structural part of the overall equipment or apparatus which is immovable relative to a molding flask to be placed within the apparatus for compression therein of molding sand. A pattern device 7 is located upon the mold table 1 and carries thereupon a molding flask or box 5 which may be filled with molding sand and a sand frame 8 which is detached upon the molding flask 5. The mold table 1 bears upon a jarring apparatus 9 which is of known design and configuration. The press 2 includes a press cylinder 12 within which there is guided a plunger 11 which carries a press plate 10.

The device represented in FIGS. 1 and 2 has applied thereto the improvement of the present invention and indicates the manner whereby the present invention may be utilized in application in a compression apparatus which operates to effect simultaneous free-fall jarring and pressing of a mold unit in accordance with known prior art means and equipment.

Arranged adjacent the fixed structural elements or columns 3 and 4 there is provided on one side thereof a support 14 which provides support for the molding box or flask 5 with a bracer bolt 29 of bracing means 63 and a bracer bolt 29*a* of bracer means 64 being correlated. Additional supports 13 for the molding box or flask 5 are provided wherein bracer bolts 35 of bracer device 65 and bracer bolt 36 of bracer device 66 are correlated.

Figure 3:
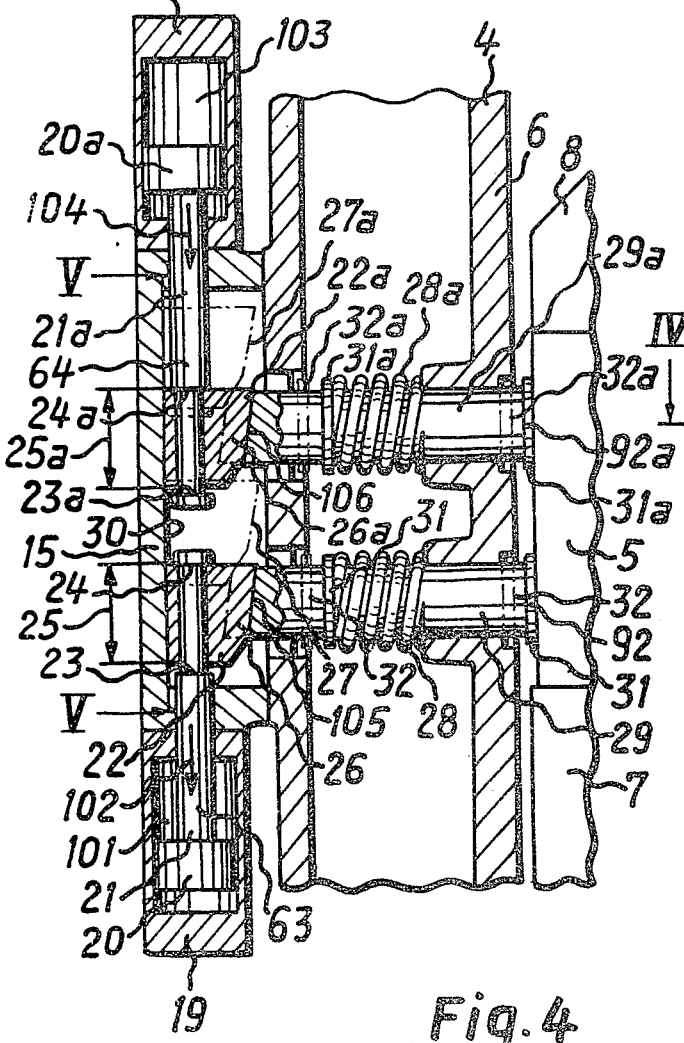
FIG. 3 is a partial sectional view taken along the line III—III of FIG. 2.
Figure 5:
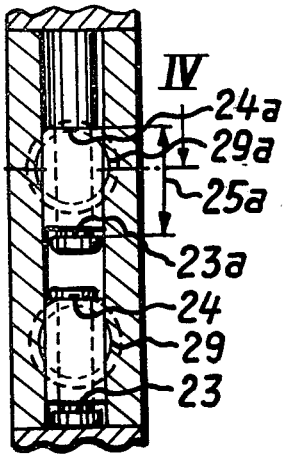
FIG. 5 is a partial sectional view taken along the line V—V of FIG. 3.
Figure 4:
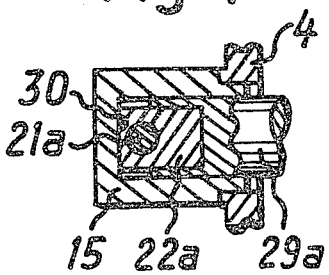
FIG. 4 is a partial sectional view taken along the line IV—IV of FIG. 5.

The supports 14 are shown in greater detail in FIGS. 3–5. A pattern device 7, a molding flask 5 and a sand frame 8 are shown. On column 4 there is secured a machine part 15 with a cylinder 19. The cylinder 19 is so connected with a wedge device 22 over a piston 20 and a piston rod 21 that the distance between faces 23 and 24 of the piston rod exceed a height 25 of the wedge 22 so that, when the piston rod 21 is actuated, it will move the wedge 22 only after it has traversed a certain distance. The wedge 22 may be moved from a position 26 into a position 27 and back, and it is pressed or biased by a spiral spring 28 over bracer bolts 29 against a sliding surface 30 of the machine part 15. Instead of spiral springs 28,28*a* there may be utilized leaf springs or other elastic means for pressing against the bracer bolts 29,29*a*. The position 26 of the wedge 22 thus corresponds to a position 31 of the bracer bolt 29 and the position 27 of the wedge 22 corresponds to a position 32 of the bracer bolt 29. An end piece 92 of the bracer bolt 29 is preferably movable, that is, it can be pressed upon the surface of the molding flask 5.

Reference numerals 19–32 and 92 refer to the lower supporting device 62 of the apparatus which actuates the bracer bolt 29, while the reference numerals 19*a*–32*a* and 92*a* refer to an upper supporting device 64 which actuates a bracer bolt 29*a*. Since both the supporting devices 63 and 64 are provided with identical reference numerals and since they work in the same manner, only the lower supporting device 63 will be described in detail it being understood that the reference characters having the reference letter "*a*" annexed thereto are intended to be composites of comparable elements having reference numerals without the annexed letter "*a*".

In the operation of the embodiment represented in FIGS. 1 and 2, after the pattern device 7 has been deposited upon the mold table 1 together with the filled molding flask 5 and with the sand frame 8, the bracing means or supporting devices 63, 64 and 65,66 are actuated and the pressure chamber 101 (see FIGS. 3–5) of the pneumatic or hydraulic cylinder 19 will receive pressure and move the piston 20 with the piston rod 21 over piston rod face 24 and wedge 22 in the direction of the arrow 102 until the bracer bolt 29 has reached the position 31. Thus, the bracer bolt will bear against the molding flask 5 without, however, causing elastic deformation of the latter. At the same time, pressure chamber 103 of the pneumatic or hydraulic cylinder 19*a* receives pressure and moves piston 20*a* with piston rod 21*a* over piston rod 24*a* in the direction of arrow 104 until bracer bolt 29*a* has reached the position 31*a*, wherein it bears against the molding flask 5 again without causing plastic deformation thereof. At the same time, and in the same manner, the supporting devices 65,66 are also actuated.

Figure 3A:
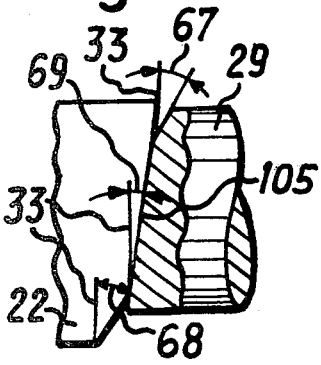
FIG. 3*a* is a partial sectional view showing in greater detail a part of FIG. 3.

As shown in FIG. 3*a*, an angle 69 between a parallel 33 of sliding surface 30 on machine part 15 and sliding surface 105 on wedge 22 and the corresponding angle between sliding surface 30 and sliding surface 106 on wedge 22*a* are so selected that the resulting friction prevents wedge 22 from sliding back opposite to the direction of the arrow 102 and the wedge 22*a* from sliding back opposite to the direction of the arrow 104. The angles 67 and 68 are selected to be greater so that the path of travel of the wedges 22 and 22*a* does not become overly long. Subsequently, operation of the press 2 is initiated and the molding sand contained within the molding flask 5 and sand frame 8 is compressed by means of the plunger 11 and the press plate 10. The jarring apparatus 9 then operates to raise the mold table 1 with all of the respective parts thereon in a known manner and subsequently drops the raised parts in a free-fall operation with this free-fall operation occurring several times on jarring cylinder 95 while the press 2 remains applied. The maximum compression which is effected in the molding sand when the mold table 1 strikes upon the jarring cylinder 95 is caused both by the resulting inertial forces in the molding sand in press plate 10 and by the compression of press 2. Since, when the mold table 1 strikes upon the jarring cylinder 95, inertia forces are produced in the wedges 22, 22*a* and in the piston rods 21,21*a* and in the piston 20,20*a*, which tend to press the bracer bolts 29,29*a* increasingly against the molding flask 5, and since the same effect is also produced at the same time in the bracing or supporting devices 65,66, the position of the supporting devices 63–66 remains unchanged during the maximum compression of the molding sand. Since the columns 3,4 are made so rigid that they are practically incapable of exerting any deformation on the forces acting on the molding flask 5 during the compression, and the bracer bolts 29,29*a, 35,36 are stressed exclusively in compression, no elastic deformation is possible during the compression at the supporter or bracer points of the mold flask 5.*

After the compression operation, the press 2 is reversed and the plunger 11 operates to lift the press plate 10 and the cylinders 19,19*a* of the supporting devices 63,64 as well as the cylinders of the supporting devices 65,66 66 which are likewise reversed and which operate to lift the wedges 22,22*a* and the wedges of the supporting devices 65,66, respectively, after which the bracer bolts 29,29*a*, 35,36 of the supporting devices 63,66 are pulled back in a known manner.

Figure 7:
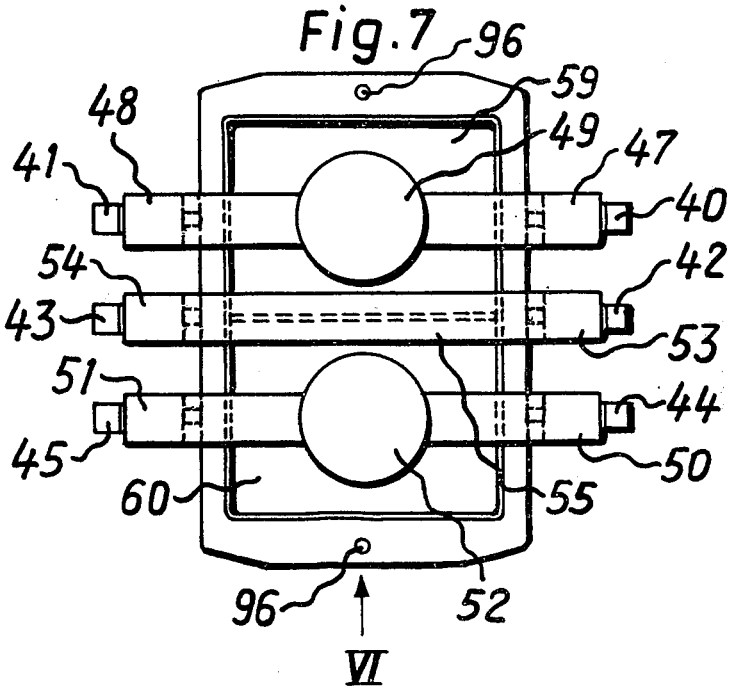
FIG. 7 is a plan view of the device shown in FIG. 6.
Figure 6:
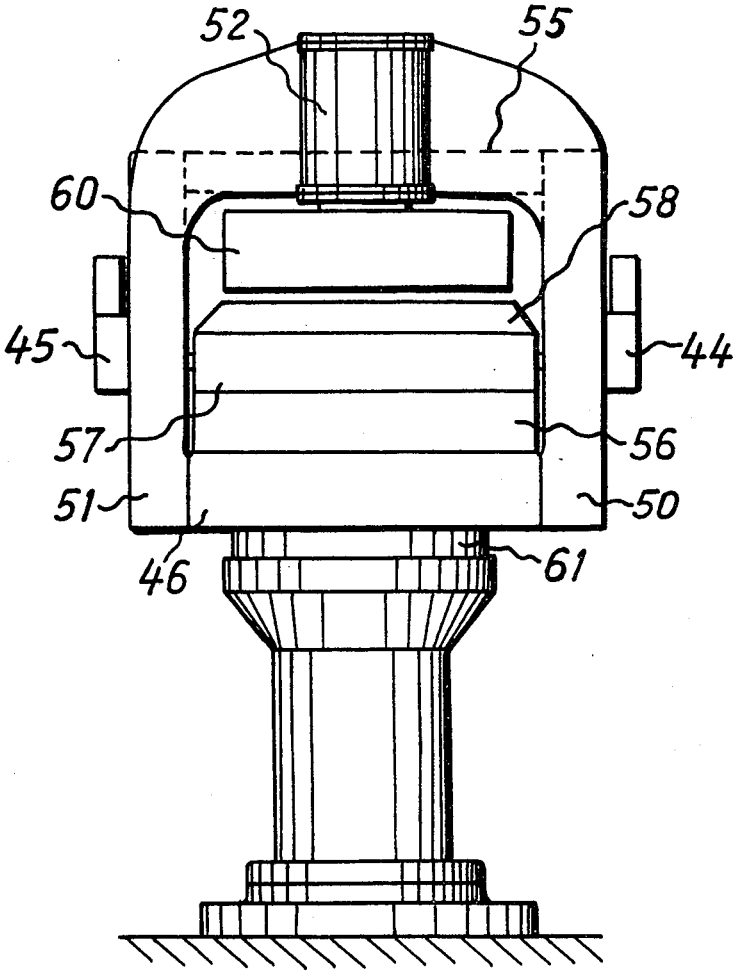
FIG. 6 is an elevational view showing apparatus embodying a modification of the present invention, the view of FIG. 6 being taken in the direction of the arrow VI shown in FIG. 7.

The embodiment of the invention depicted in FIGS. 1 and 2 shows the application of the invention in the production of casting mold parts which are relatively high and which have relatively smaller mold faces. However, the embodiment modification shown in FIGS. 6 and 7 depicts and exemplifies an application of the invention wherein relatively low casting mold parts are involved having relatively larger mold faces. In the embodiment depicted in FIGS. 6 and 7 there is included columns 47 and 48 each of which is rigidly connected with a mold table 46 and a press 49 and upon which the supporting or bracing devices, respectively, bear. Furthermore, columns 50 and 51 are provided which are rigidly connected with the mold table 46 and a press 52, upon which the supporting devices 44 and 45 respectively bear. Furthermore, columns 53 and 54 which are rigidly connected with the mold table 46 and with a cross piece 55 are provided and supporting or bracing devices 42 and 43 bear, respectively, upon the columns 53,54. Upon the mold table 46 there is applied a pattern device 56, a molding box or flask 57 which is filled with molding sand and a sand frame 58. A press plate 59 is associated with the press 49 and a press plate 60 is associated with the press 52. The mold table 46 bears on a jarring apparatus 61 of known design.

In the operation of the embodiment of the invention represented in FIGS. 6 and 7 there exist aspects of operation which differ from the operation of the embodiment shown in FIG. 1 only with regard to the arrangement involved. The basic mode of operation is the same and thus it will not be here described in detail.

Figure 8:
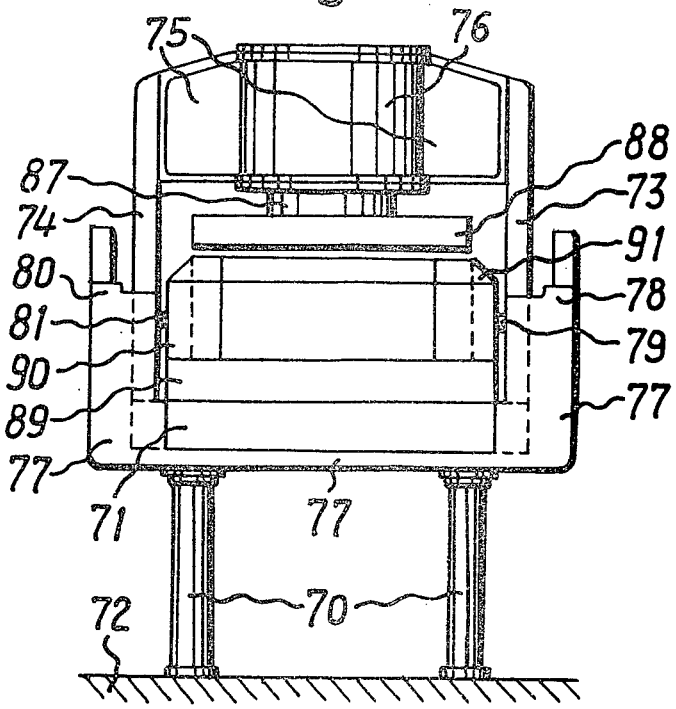
FIG. 8 is an elevational view of an embodiment involving a further modification of the invention, the view of FIG. 8 being taken in the direction of the arrow VIII shown in FIG. 9.
Figure 9:
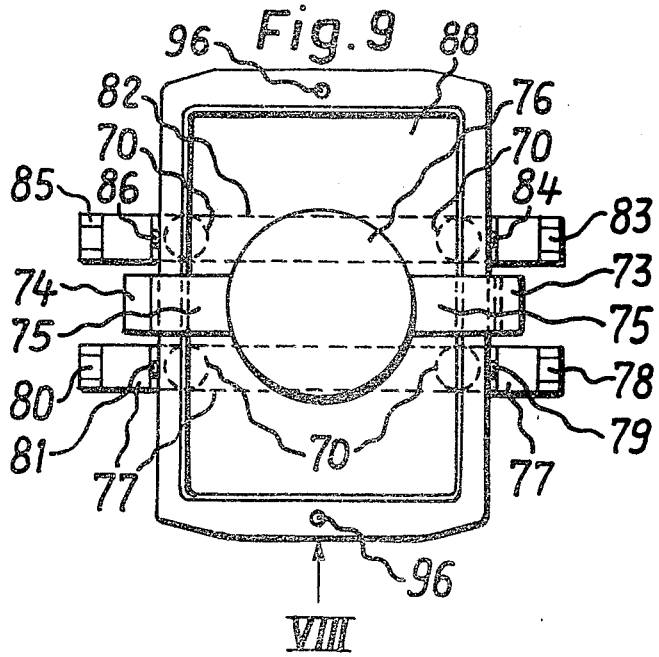
FIG. 9 is a plan view of the modification depicted in FIG. 8.

Another embodiment of the present invention is depicted in FIGS. 8 and 9. In this embodiment there is shown a molding machine which compresses the casting mold parts by a pressing operation without a free-fall jarring action. A mold table 71 bears over four columns 70 upon a foundation 72. The mold table 71 carries over two columns 72 and 74 a cross piece 75 of a press 76. A part of the mold table 71 is designed as a stirrup 77 which has on one side a supporting device 78 with a bracer bolt 79, On the other side is a bracer or supporting device 80 with a bracer bolt 81. Another part of the mold table 71 is likewise designed as a stirrup 82 and has on one side thereof a bracer device 83 with a bracer bolt 84. On the other side is a bracer device 85 with a bracer bolt 86. The press 76 is connected over a plunger 87 with a press plate 88. Upon the mold table 71 there bears a pattern device 89. Upon the pattern device 89 is attached a molding flask 90 which is filled with sand and upon which there is, in turn, attached a sand frame 91.

In the operation of the modification of the embodiment represented in FIGS. 8 and 9, a conveying apparatus (not shown) first deposits or conveys to the mold table 71 the pattern device 89, the molding flask 90 filled with molding sand and the frame 91. Thereafter, the supporting or bracing devices 78,80, 83 and 85 are actuated in the manner previously described. The bracer bolts 79,81,84,86 are applied to bear against the molding flask 90 and in this manner prevent the elastic deformation of the molding box 90 at the braced point. This occurs during compression of the casting mold part. The compression of the mold is effected by pressing action resulting from the starting of the press 76 and pressing plate 88 operating over plunger 87 agaist the molding sand to apply the compressive forces thereto. After the compression, the press plate 88 is raised in the manner described previously in reference to FIGS. 1 and 2, and the bracer bolts 79,81,84 and 86 are retracted by actuating the bracing devices 78,80 and 83,85.

The supporting device according to the present invention, which supports the molding flask of the casting mold parts upon a machine part which does not change its position relative to the molding flask during compression, may be used in all known molding machines which produce molding parts by compression operation.

The supporting or bracing devices according to the invention can be used not only to support the longitudinal walls of the molding flasks, but they may be also utilized to support all molding flask walls. Experience has shown that the molding flask walls wherein there is provided dowel guides such as the dowel guides 96 depicted in FIGS. 2, 7 and 9 are preferably stiffened by a corresponding increase in the profile of the molding flask.

While specific embodiments of the invention have been shown and described in detail to illustrate the application of the inventive principles, it will be understood that the invention may be embodied otherwise without departing from such principles.

I claim:

1. In a mold forming apparatus for the production of casting molds in molding flasks operating to compress mold forming material contained within said mold flask, the improvement comprising bracer means including bracer elements acting in opposed relationship to each other to brace said mold flask and structural means located to be fixed in position relative to said mold flasks during compression of said mold forming material, said bracer means operating to brace said mold flasks against said fixed structural means, said bracer elements comprising bracer bolts arranged to be adjusted with relation to said mold flasks, said apparatus further comprising wedges which are mounted in slidable engagement relative to said fixed structural means in order to thereby operate to adjust the position of said bracer bolts against said mold flasks.

2. Apparatus according to claim 1 including spring means biasing said bracer bolts away from said mold flasks.

3. Apparatus according to claim 2 further including fluid pressure means operating to actuate said wedges to effect movement of said wedges relative to said bracer bolts to adjust the position of said bracer bolts relative to said mold flasks.

4. Apparatus according to claim 3 wherein said wedges are arranged to be moved in vertical directions.

5. Apparatus according to claim 3 wherein said fluid pressure means comprise fluid pressure cylinder means and piston rod means operating within said cylinder means, said piston rod means having piston rod surfaces engaging said wedges to actuate said wedges in two opposed directions, said piston rod surfaces being spaced apart a distance greater than the height of said wedges to enable said piston rod means to move through a portion of an actuating stroke without engagement of said piston rod surfaces with said wedges.

6. Apparatus according to claim 1 wherein said mold forming apparatus includes a mold table and wherein said bracing devices bear against part of said mold table.

7. Apparatus according to claim 1 further including a mold table and a press arranged above said mold table with said compression of said casting molds occurring between said press and said mold table, said apparatus also including a plurality of columns rigidly extending between said mold table and said press and rigidly interconnected therebetween, said bracing devices being mounted upon said columns.

8. Apparatus according to claim 7 further including a cross piece extending between said columns, said columns upon which said bracing devices are mounted being rigidly connected both with said molding flask and with said cross piece.

9. In mold forming apparatus for the production of casting molds in molding flasks including a mold table for supporting said mold flasks and means operating to compress mold forming material contained within said mold flasks while said flasks are supported on said mold table, the improvement comprising bracer means including individual bracer elements located externally of said flasks and acting thereagainst in opposed relationship to each other to apply to said flasks forces to brace and support the walls of said mold flasks against forces generated therein as a result of compression within said mold flasks of said mold forming material by operation of said compressing means during said mold forming operations, said bracer elements thereby operating to resist deformation of said flask walls resulting from said compression therein of said mold material, and structural means including upstanding frame means supporting said bracer elements and having said bracer elements arranged in operative relationship therewith for movement into and out of an advanced position in which said bracer elements contact the walls of said mold flasks, said frame means being located to be fixed in position relative to said mold flasks during compression of said molding material, said bracer means further including actuating means for said bracer elements and locking means cooperating with said bracer elements in said advanced position for maintaining said position independently of the compression forces developed in said mold flasks, said bracer elements operating to brace said mold flasks against said fixed frame of said structural means.

10. Apparatus according to claim 9 wherein said upstanding frame means are rigidly connected to said mold table.

11. Apparatus according to claim 10 wherein said frame means include a pair of vertical columns each having upper and lower ends, said lower ends being rigidly connected to said mold table on opposite sides thereof.

* * * * *